US010254688B2

(12) United States Patent
Ishii

(10) Patent No.: US 10,254,688 B2
(45) Date of Patent: Apr. 9, 2019

(54) IMAGE FORMING APPARATUS WITH PIVOTING FIXING DEVICE

(71) Applicant: KYOCERA Document Solutions Inc., Osaka-shi, Osaka (JP)

(72) Inventor: Takeshi Ishii, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 65 days.

(21) Appl. No.: 15/877,198

(22) Filed: Jan. 22, 2018

(65) Prior Publication Data

US 2018/0210382 A1 Jul. 26, 2018

(30) Foreign Application Priority Data

Jan. 24, 2017 (JP) ..... 2017-010197

(51) Int. Cl.
*G03G 15/20* (2006.01)
*G03G 21/16* (2006.01)

(52) U.S. Cl.
CPC ..... *G03G 15/2035* (2013.01); *G03G 21/1685* (2013.01)

(58) Field of Classification Search
CPC ..... G03G 15/2071; G03G 15/2035; G03G 15/2032; G03G 21/1685; G03G 2221/2032
See application file for complete search history.

(56) References Cited

U.S. PATENT DOCUMENTS

2004/0190939 A1* 9/2004 Yamanaka ..... G03G 15/2032 399/122

FOREIGN PATENT DOCUMENTS

JP 2014191134 A 10/2014

* cited by examiner

*Primary Examiner* — Sandra Brase
(74) *Attorney, Agent, or Firm* — Alleman Hall Creasman & Tuttle LLP

(57) ABSTRACT

An image forming apparatus includes an apparatus main body and a fixing device. The apparatus main body is formed such that its interior can be opened. The fixing device is provided in the interior of the apparatus main body and configured to fix a toner image on a medium to the medium by heating and pressing the toner image. The fixing device is supported by the apparatus main body in such a way as to pivot so as to be disposed on an outside of the apparatus main body in a state where the interior of the apparatus main body is opened.

3 Claims, 12 Drawing Sheets

IMAGE FORMING APPARATUS WITH PIVOTING FIXING DEVICE

INCORPORATION BY REFERENCE

This application is based upon and claims the benefit of priority from the corresponding Japanese Patent Application No. 2017-010197 filed on Jan. 24, 2017, the entire contents of which are incorporated herein by reference.

BACKGROUND

The present disclosure relates to an image forming apparatus.

An electrophotographic image forming apparatus includes a fixing device which thermally fixes a toner image to a medium passing through a nip formed by a fixing member and a pressure member both of which rotate. In the fixing device, it may happen that the medium is jammed at the nip.

There is known an image forming apparatus for smoothly performing a removal of the medium (paper sheet) jammed at the nip (a jam handling process). For example, there is known a conventional image forming apparatus provided with a nip-pressure changing mechanism that reduces a pressure applied to the nip (a nip pressure), in conjunction with opening of a cover of an apparatus main body that stores the fixing device. The configuration facilitates the worker in pulling out the paper sheet jammed at the nip.

SUMMARY

An image forming apparatus according to an aspect of the present disclosure includes an apparatus main body and a fixing device. The apparatus main body is formed such that its interior can be opened. The fixing device is provided in the interior of the apparatus main body and configured to fix a toner image on a medium to the medium by heating and pressing the toner image. The fixing device is supported by the apparatus main body in such a way as to pivot so as to be disposed on an outside of the apparatus main body in a state where the interior of the apparatus main body is opened.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
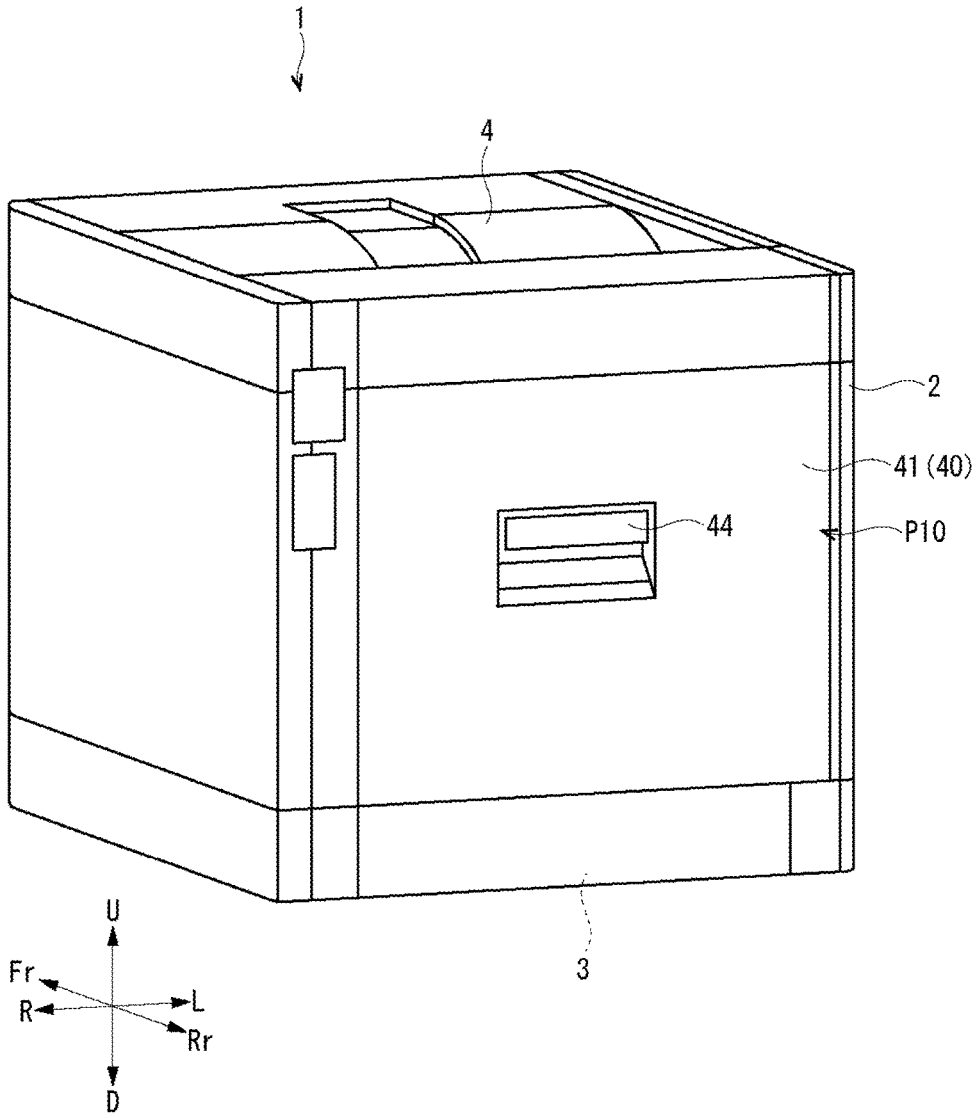
FIG. 1 is a perspective view of a color printer according to an embodiment of the present disclosure.

The following describes an embodiment of the present disclosure with reference to the accompanying drawings. It is noted that in the drawings, "Fr" represents "front", "Rr" represents "rear", "L" represents "left", "R" represents "right", "U" represents "up", and "D" represents "down". In addition, the terms "upstream", "downstream" and the like mean an upstream, a downstream and the like in a conveyance direction of a sheet S.

<Outline of Color Printer>

Figure 2:
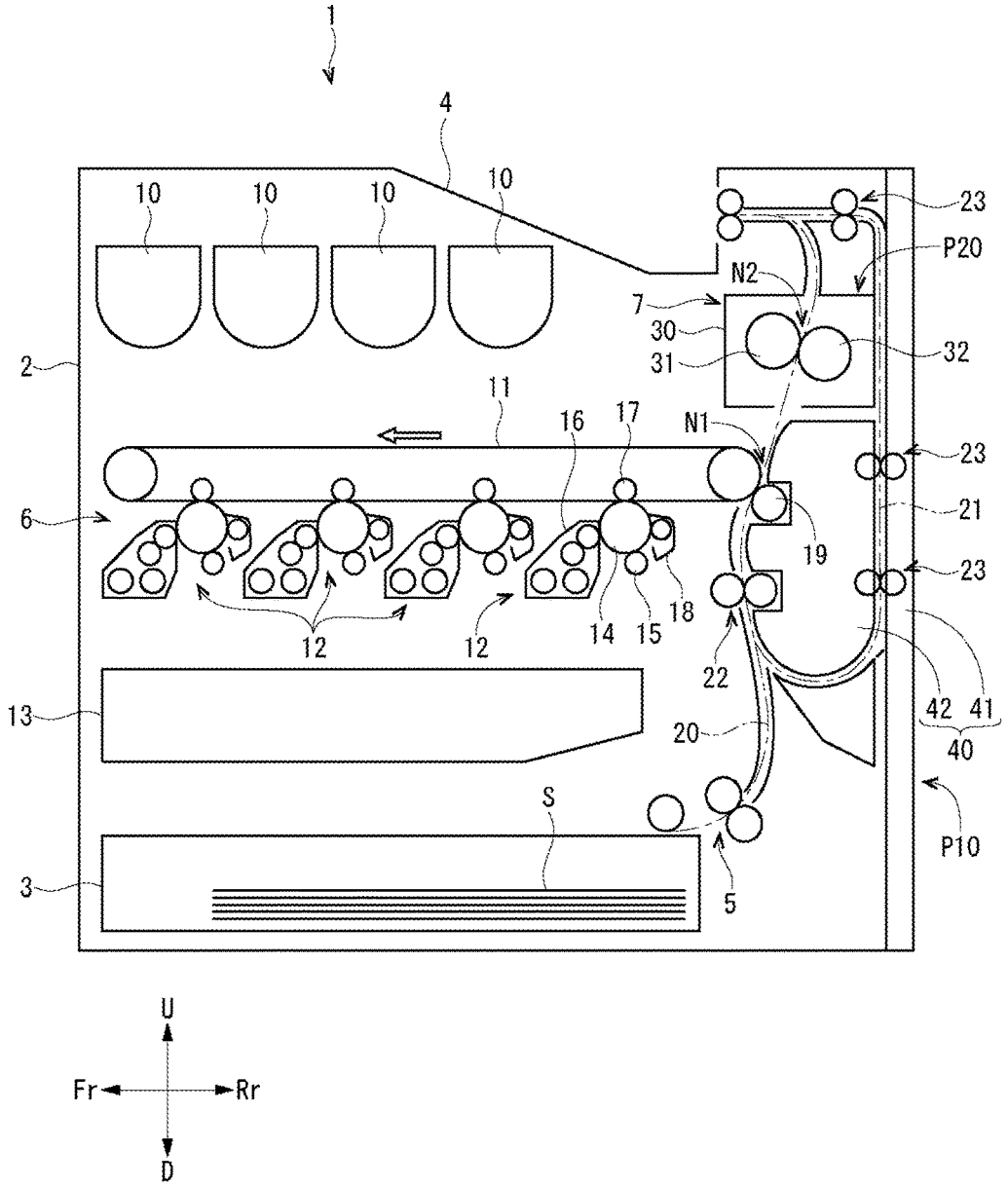
FIG. 2 is a schematic cross-sectional view of an internal structure of the color printer according to the embodiment of the present disclosure.

A color printer 1 according to the present embodiment is described with reference to FIG. 1 and FIG. 2. FIG. 1 is a perspective view of the color printer 1. FIG. 2 is a schematic cross-sectional view showing an internal structure of the color printer 1.

As shown in FIG. 1, the color printer 1 as an example of the image forming apparatus includes an apparatus main body 2 whose outer appearance is in the approximate shape of a rectangular parallelepiped. A sheet supply cassette 3 storing paper sheets S in a stack is attached to a lower part of the apparatus main body 2 in a detachable manner. It is noted that the sheet S is an example of the medium, and is not limited to a sheet of paper, but may be a sheet of resin, for example.

As shown in FIG. 2, the color printer 1 includes a sheet supply device 5, an image forming device 6, and a fixing device 7 in the interior of the apparatus main body 2. The sheet supply device 5 is provided at an upstream end of a conveyance path 20 which extends from the sheet supply cassette 3 to a sheet discharge tray 4. The fixing device 7 is provided on a downstream side in the conveyance path 20. The image forming device 6 is provided between the sheet supply device 5 and the fixing device 7 in the conveyance path 20.

The image forming device 6 includes four toner containers 10, an intermediate transfer belt 11, four drum units 12, and a laser scanning device 13. The four toner containers 10 respectively store toner (developer) of four colors (yellow, magenta, cyan, and black). The intermediate transfer belt 11 rotates in a direction indicated by an arrow in FIG. 2. Each of the drum units 12 includes a photoconductor drum 14, a charging device 15, a developing device 16, a primary transfer roller 17, and a cleaning device 18. The primary transfer rollers 17 are arranged to face the photoconductor drums 14 respectively across the intermediate transfer belt 11. A transfer nip N1 is formed between a secondary transfer roller 19 and a rear-end portion of the intermediate transfer belt 11 that are in contact with each other.

When viewed from a side, the conveyance path 20 is formed in the approximate shape of letter S extending along an up-down direction (vertical direction) in a rear-side part of the apparatus main body 2. On a further rear side of the conveyance path 20, a reverse conveyance path 21 is provided to reverse the sheet S and convey it to the image forming device 6 again. The reverse conveyance path 21 branches off from the conveyance path 20 at a downstream of the conveyance path 20 and extends downward. A downstream end of the reverse conveyance path 21 merges with an upstream part of the conveyance path 20.

The conveyance path 20 includes a pair of registration rollers 22. The pair of registration rollers 22 temporarily hold the sheet S conveyed in the conveyance path 20, and correct the skew of the sheet S. The reverse conveyance path 21 includes a plurality of pairs of conveyance rollers 23. The pair of registration rollers 22 and the pairs of conveyance rollers 23 feed the sheet S toward the downstream by rotating while nipping the sheet S.

The color printer 1 performs an image formation operation in the following procedure. The charging device 15 charges the surface of the photoconductor drum 14. The photoconductor drum 14 receives scanning light emitted from the laser scanning device 13 and carries an electrostatic latent image. The developing device 16 develops the electrostatic latent image on the photoconductor drum 14 by using toner supplied from a corresponding toner container 10. The primary transfer roller 17 primarily transfers a toner image from the surface of the photoconductor drum 14 to the rotating intermediate transfer belt 11. The intermediate transfer belt 11, while rotating, carries a full-color toner image formed from toner images of the four colors that were primarily transferred and overlaid thereon. A sheet S is fed from the sheet supply cassette 3 by the sheet supply device 5 into the conveyance path 20. The secondary transfer roller 19 secondarily transfers the toner image from the intermediate transfer belt 11 to a surface of the sheet S when the sheet S passes through the transfer nip N1. The fixing device 7 heats and presses the toner image on the sheet S so as to fix the toner image to the sheet S. Thereafter, the sheet S is discharged to the sheet discharge tray 4. The cleaning device 18 removes residual toner from the surface of the photoconductor drum 14.

During a double-sided printing performed on the sheet S, the sheet S, after passing through the fixing device 7, is switched back at a downstream end portion of the conveyance path 20 and sent to the reverse conveyance path 21. The sheet S enters the conveyance path 20 again from the reverse conveyance path 21, and is conveyed toward the image forming device 6 again so that an image is also formed on a back side of the sheet S.

<Fixing Device>

Figure 3:
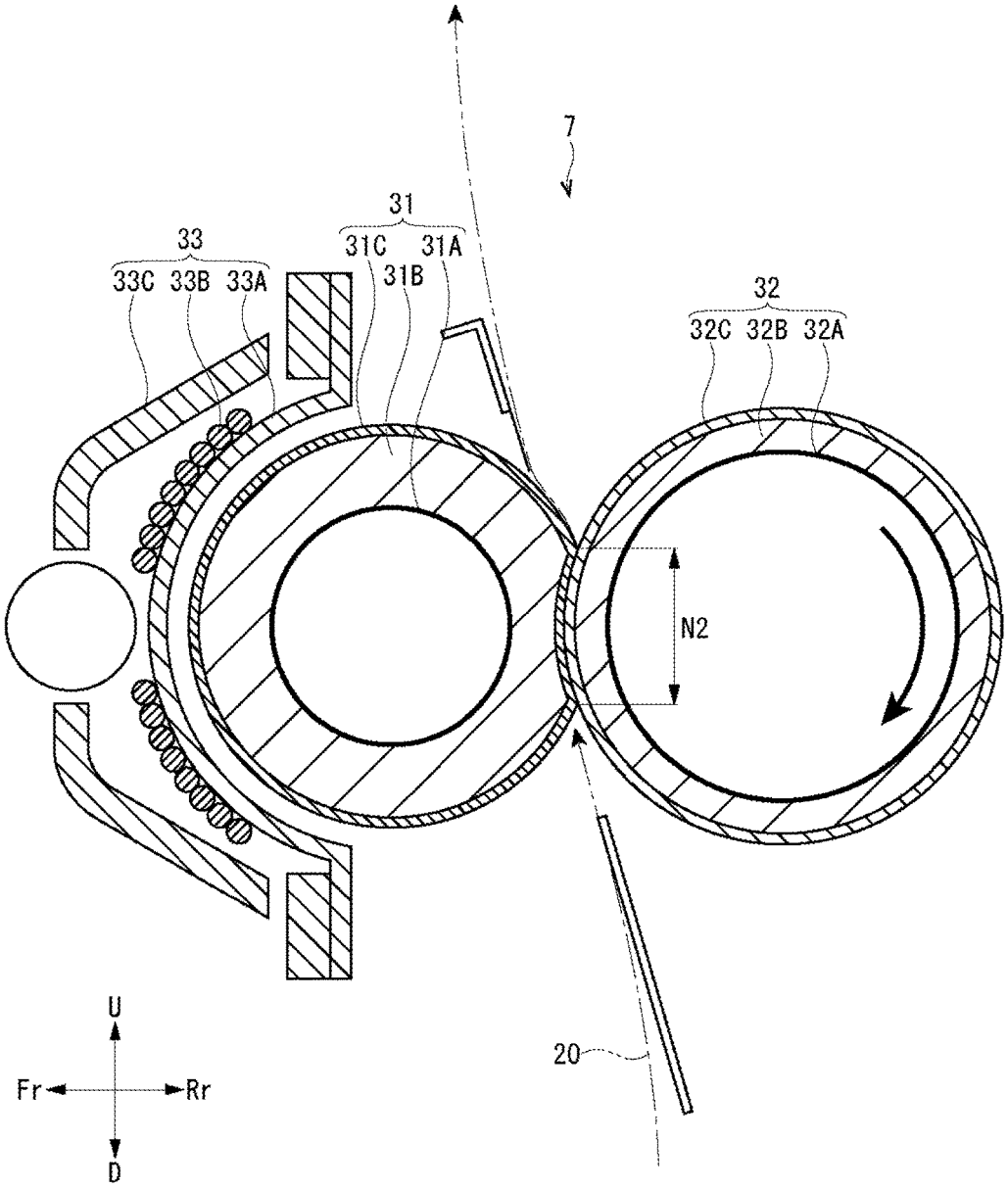
FIG. 3 is a schematic cross-sectional view of a fixing device of the color printer according to the embodiment of the present disclosure.
Figure 4:
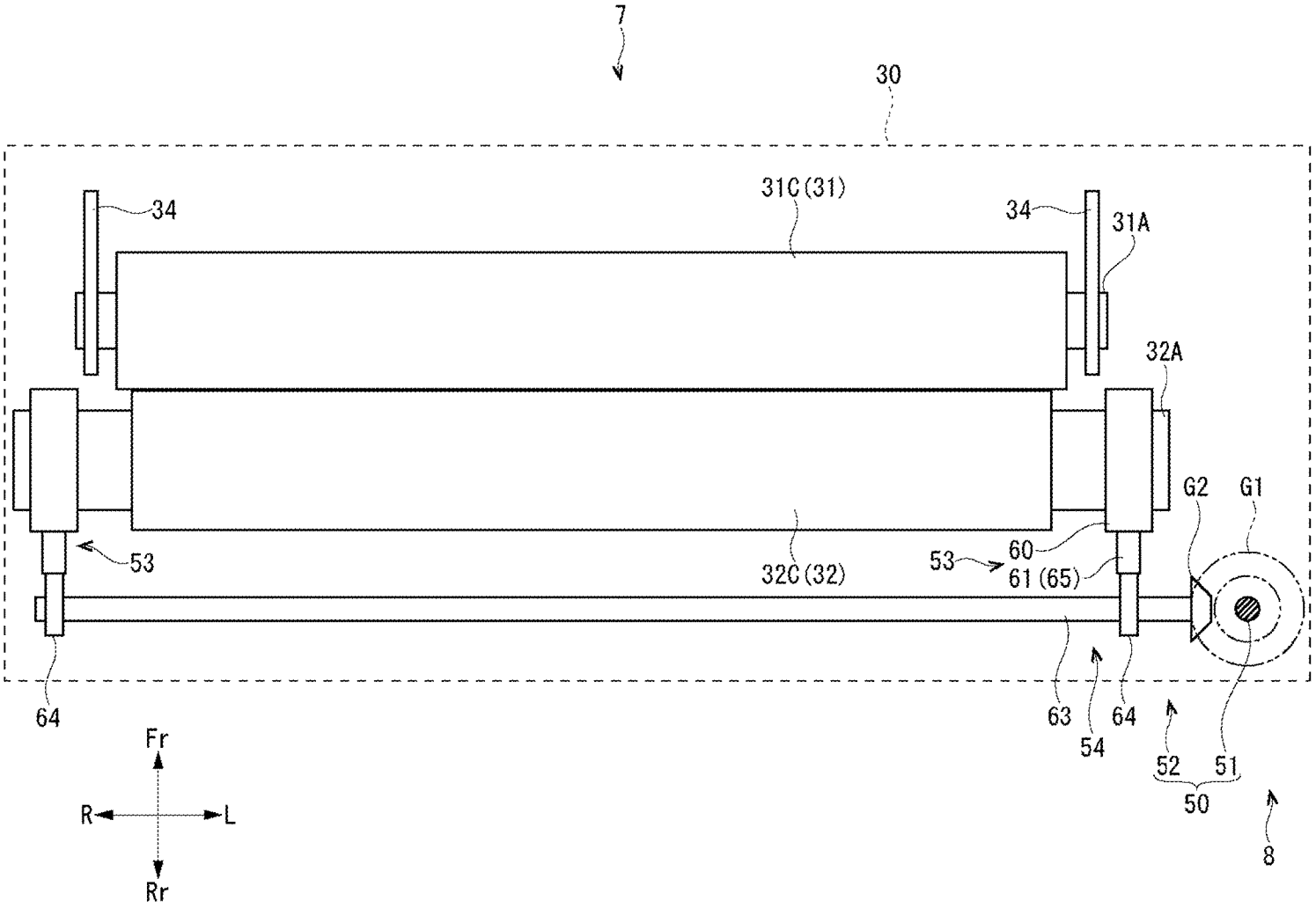
FIG. 4 is a schematic plan view of the fixing device of the color printer according to the embodiment of the present disclosure.

The fixing device 7 is described with reference to FIG. 3 and FIG. 4. FIG. 3 is a schematic cross-sectional view of the fixing device 7. FIG. 4 is a schematic plan view of the fixing device 7.

The fixing device 7 includes a fixing case 30, a fixing roller 31, a pressure roller 32, and a heat-generating unit 33. The fixing case 30 is formed in the approximate shape of a rectangular parallelepiped. The fixing roller 31 and the pressure roller 32 are each formed in the approximate shape of a cylinder that is elongated in a left-right direction. The heat-generating unit 33 is a device configured to heat the fixing roller 31.

As shown in FIG. 3, the fixing roller 31 that is an example of the fixing member, includes a fixing elastic layer 31B and a fixing belt 31C, wherein the fixing elastic layer 31B is formed on an outer circumferential surface of a fixing metal core 31A made of a metal, and the fixing belt 31C covers the fixing elastic layer 31B. The pressure roller 32 that is an example of the pressure member, includes a pressure elastic layer 32B and a pressure release layer 32C, wherein the pressure elastic layer 32B is formed on an outer circumferential surface of a pressure metal core 32A, and the pressure release layer 32C covers the pressure elastic layer 32B.

As shown in FIG. 4, the fixing roller 31 and the pressure roller 32 are stored in the interior of the fixing case 30. Left and right end portions of the fixing metal core 31A are rotatably supported by a pair of sheet metals 34 that are fixed in the fixing case 30. The left and right end portions of the pressure metal core 32A are rotatably supported by a pair of movable sheet metals 53 provided in the fixing case 30. The pressure roller 32 and the fixing roller 31 are in contact with each other and form a fixing nip N2 (see FIG. 3). It is noted that the fixing case 30 has openings respectively in upper and lower surfaces thereof so that the sheet S can pass through the fixing case 30 to the fixing nip N2 (see FIG. 2).

As shown in FIG. 3, the heat-generating unit 33 is provided opposite to the fixing nip N2 across the fixing roller 31. The heat-generating unit 33 includes a plurality of IH coils 33B that are supported by a holder 33A of the approximate shape of a cylinder. The plurality of IH coils 33B are covered with an arch core 33C formed from a ferromagnetic material such as ferrite.

Here, action of the fixing device 7 is described. The pressure roller 32 is connected to a motor (not shown) via a gear or the like, and upon receiving a driving force from the motor, rotates around an axis. The fixing roller 31 rotates around an axis following the rotation of the pressure roller 32. The IH coils 33B receive supply of power from a power source (not shown) and generate high-frequency magnetic fields so as to heat the fixing belt 31C. The fixing roller 31, while rotating, heats the toner image on the sheet S that passes through the fixing nip N2. The pressure roller 32, while rotating, applies a pressure to the sheet S that passes through the fixing nip N2. This allows the toner image to be fixed to the sheet S. It is noted that in the present embodiment, the pressure roller 32 is rotationally driven. However, not limited to this configuration, the fixing roller 31 may be rotationally driven, and the pressure roller 32 may be configured to rotate following the rotation of the fixing roller 31.

In the color printer 1, the sheet S may be jammed in the conveyance path 20, the reverse conveyance path 21 or the like. As described in detail below, the apparatus main body 2 is formed such that the interior thereof can be opened so that the jammed sheet S can be removed therefrom. A control device (not shown) of the color printer 1 detects a jam of the sheet S by receiving an output from a sensor (not shown) disposed in the conveyance path 20 or the reverse conveyance path 21. Upon detecting an occurrence of a jam, the control device stops the image formation operation, and displays, on a liquid crystal display or the like (not shown), a message or the like that indicates the occurrence of the jam. The user executes a predetermined jam handling process by opening the interior of the apparatus main body 2 in accordance with the message. The color printer 1 according to the present embodiment is provided with a jam handling structure 8 that facilitates the user in performing the jam handling process.

<Jam Handling Structure>

Figure 5:
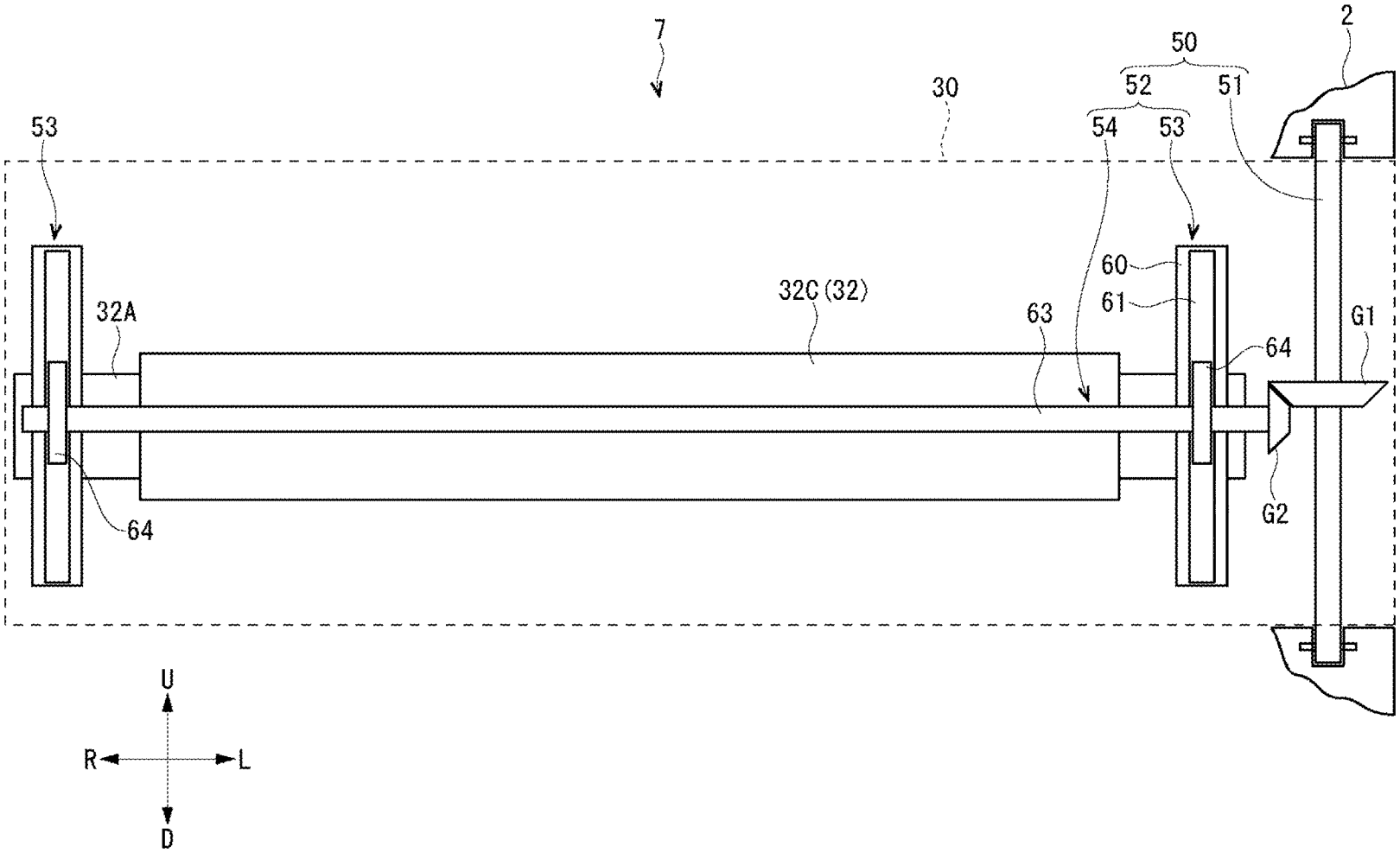
FIG. 5 is a schematic back view of the fixing device of the color printer according to the embodiment of the present disclosure.
Figure 6:
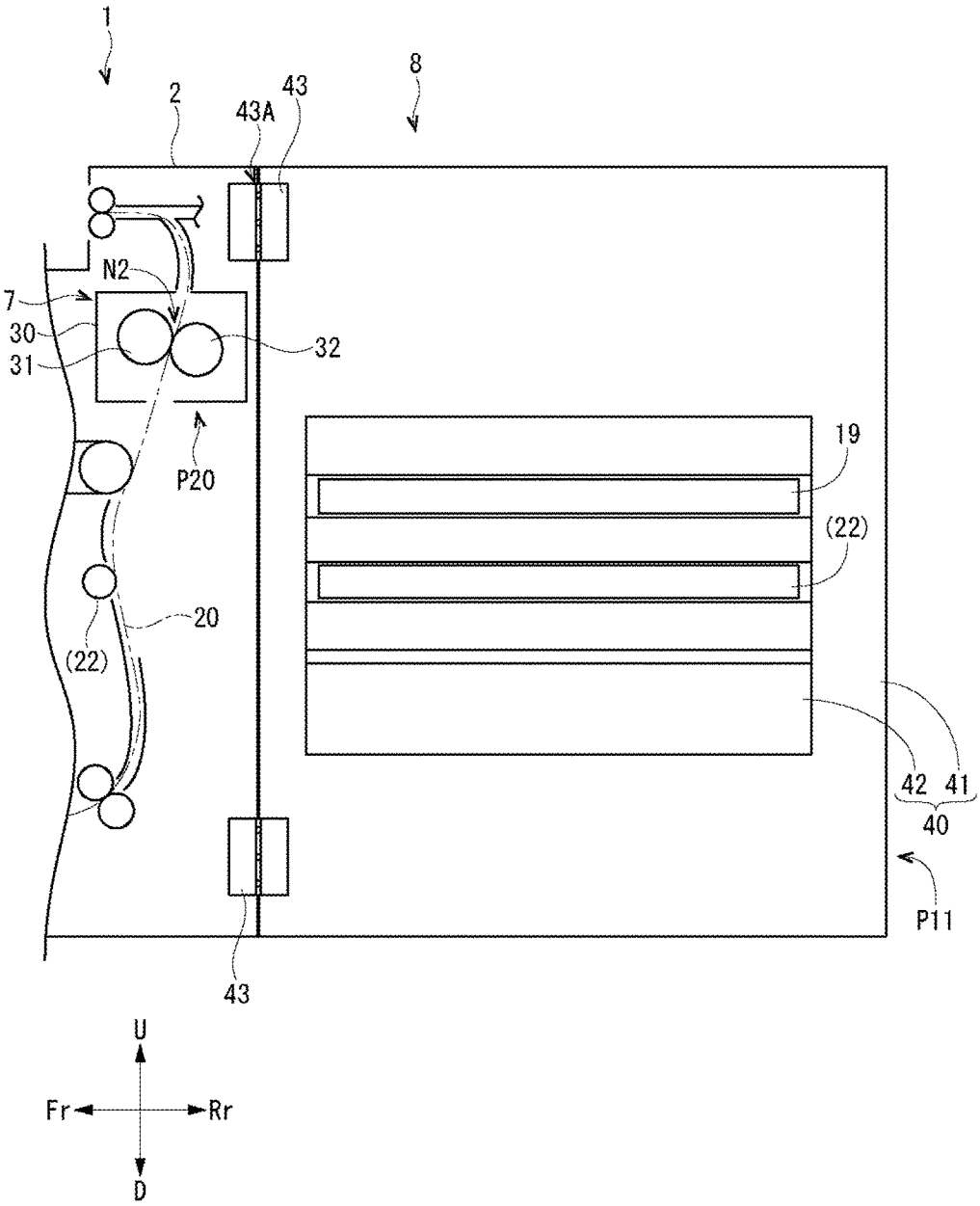
FIG. 6 is a schematic side view of a jam handling structure of the color printer according to the embodiment of the present disclosure.
Figure 7:
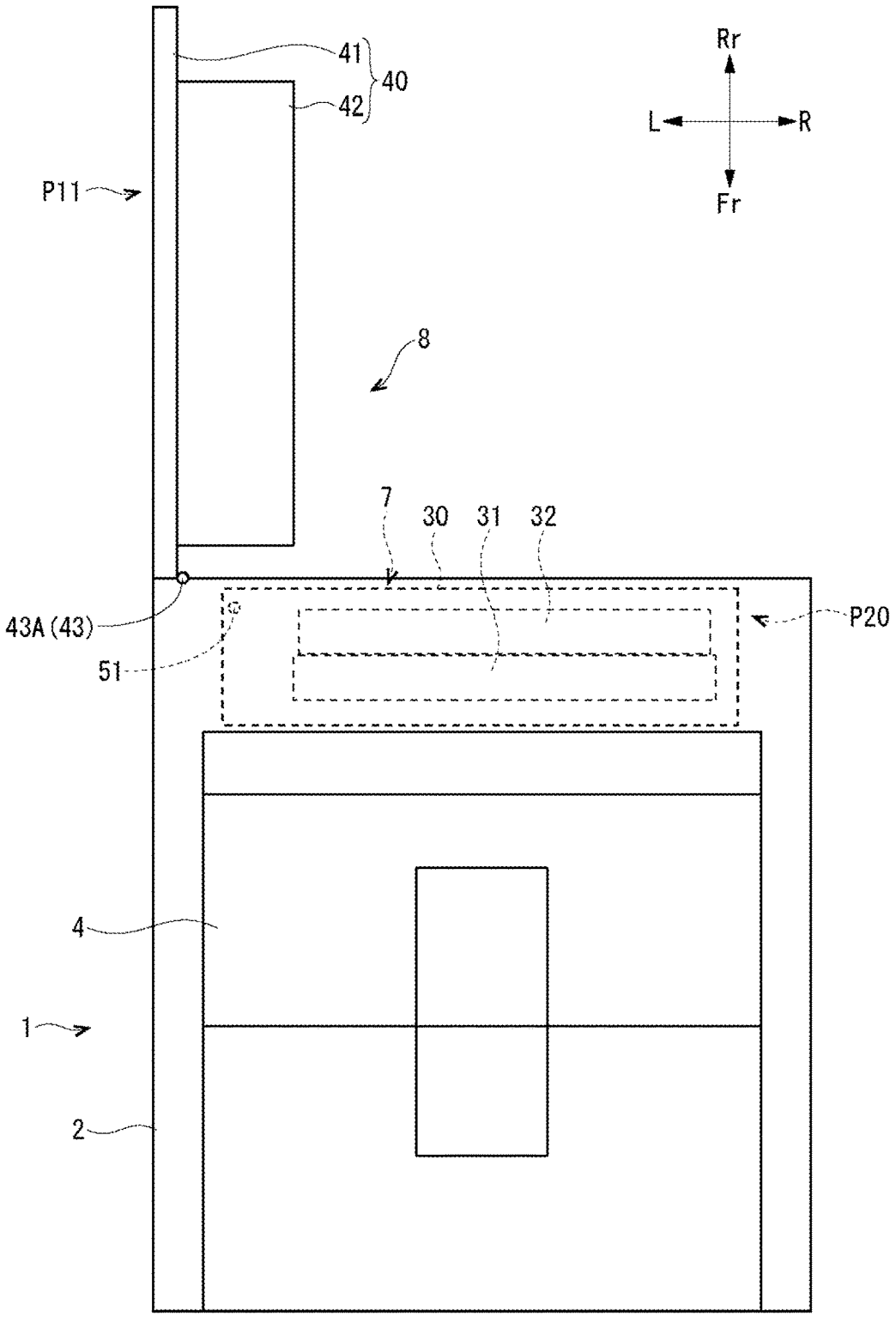
FIG. 7 is a schematic plan view of the jam handling structure of the color printer according to the embodiment of the present disclosure.
Figure 8:
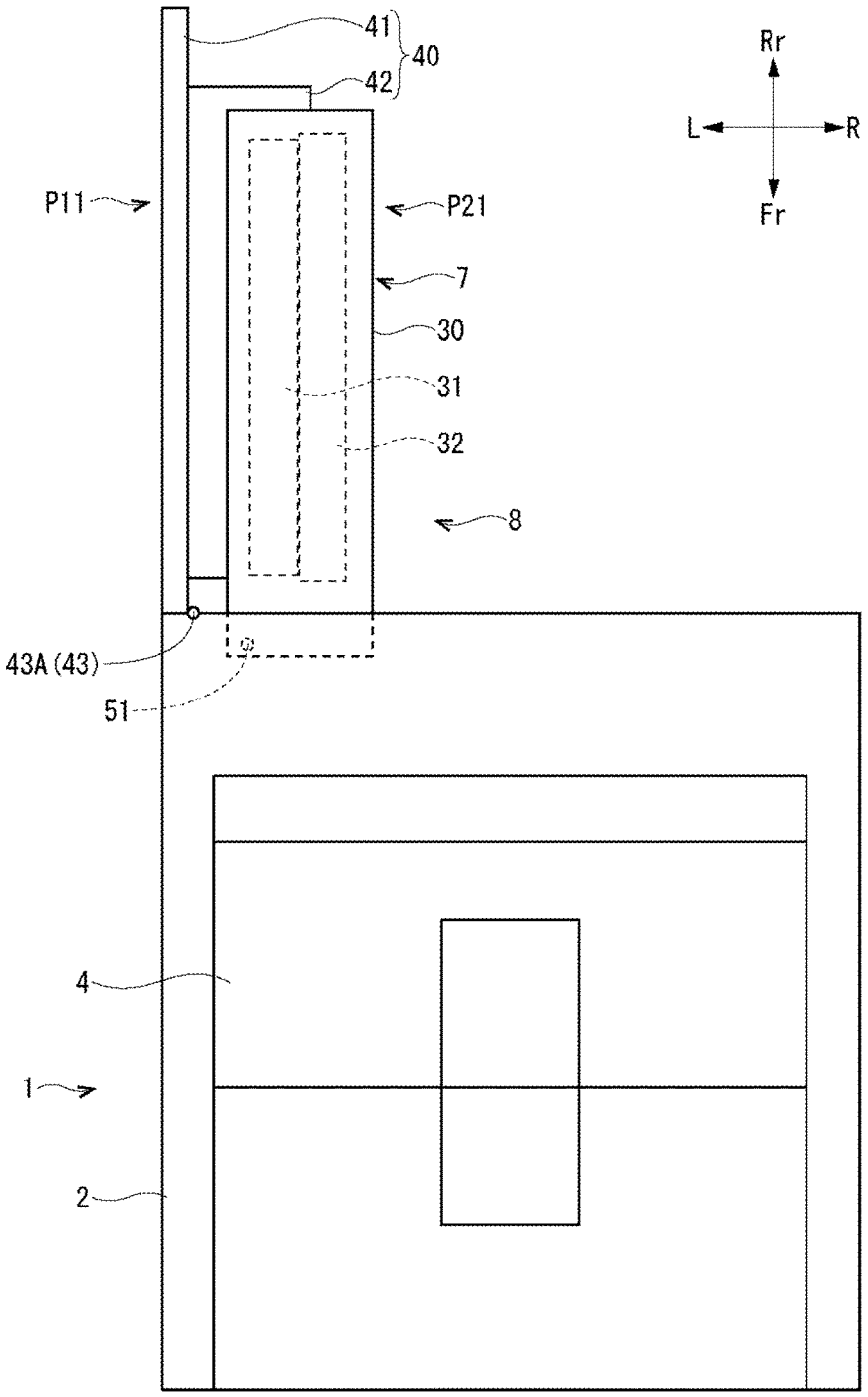
FIG. 8 is a schematic plan view of the jam handling structure of the color printer according to the embodiment of the present disclosure in a state where the fixing device is disposed at a jam handling position.
Figure 9:
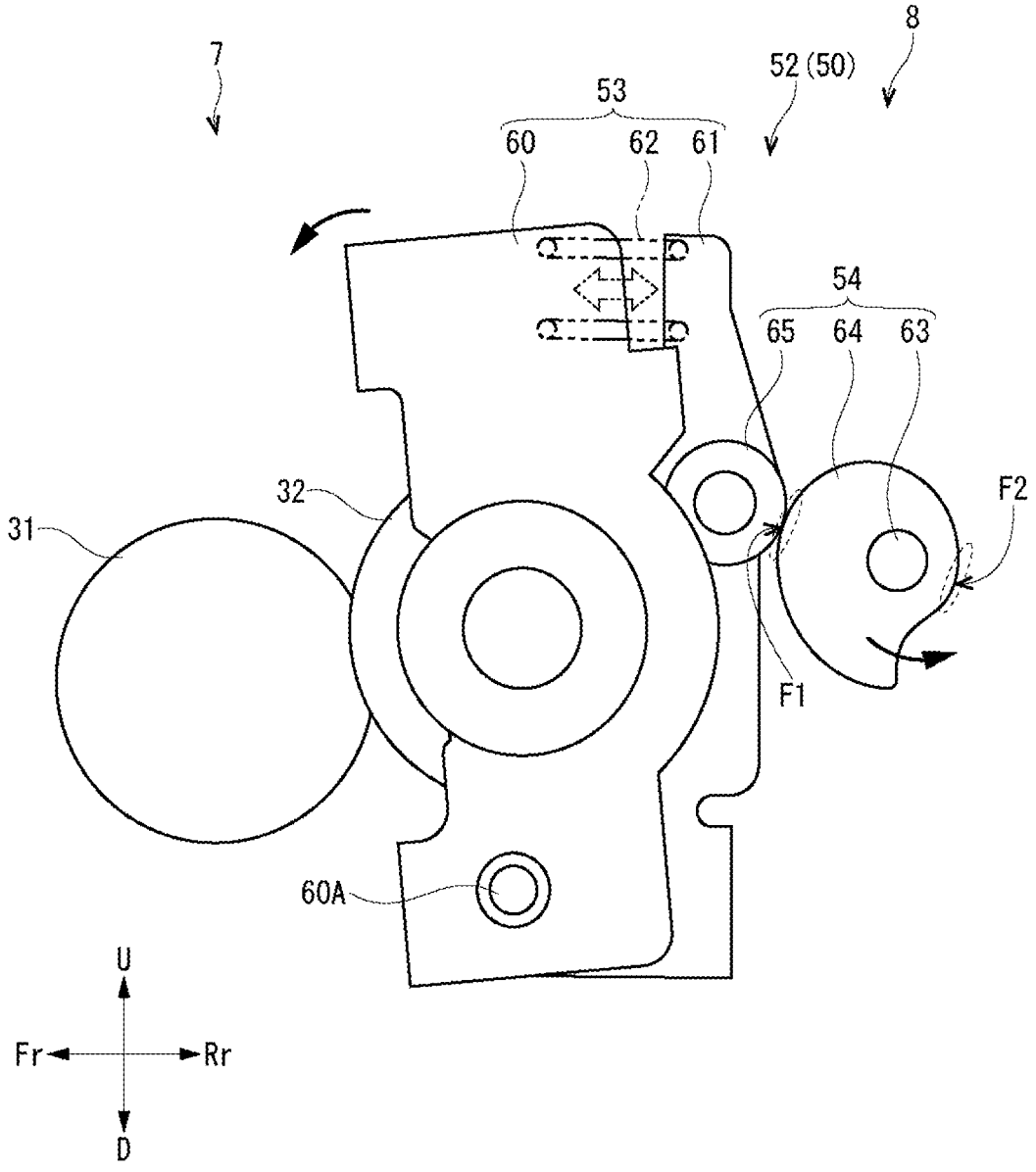
FIG. 9 is a schematic side view of the fixing device (in a pressurized state) of the color printer according to the embodiment of the present disclosure.
Figure 10:
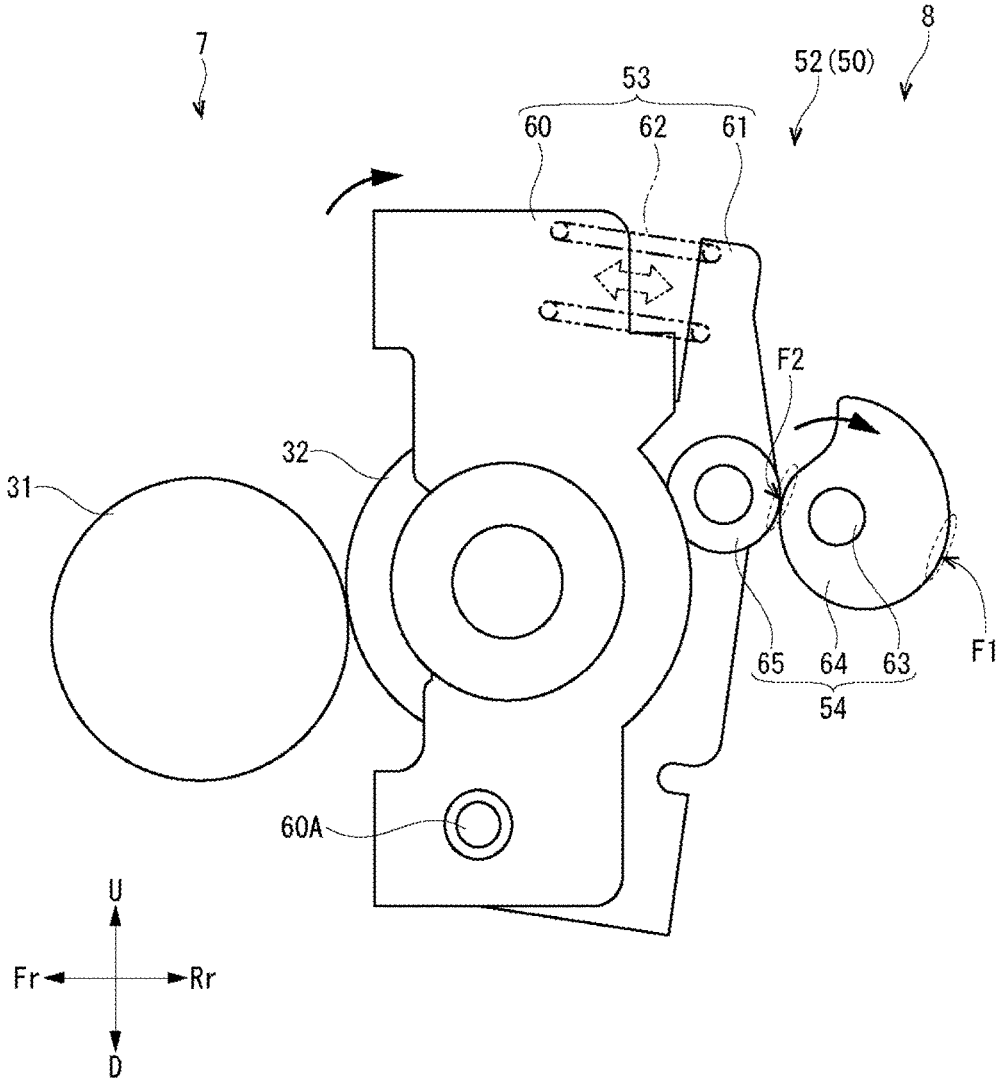
FIG. 10 is a schematic side view of the fixing device (in a reduced-pressure state) of the color printer according to the embodiment of the present disclosure.

The jam handling structure 8 is described with reference to FIG. 2 and FIG. 4 to FIG. 10. FIG. 5 is a schematic back view of the fixing device 7. FIG. 6 is a schematic side view of the jam handling structure 8. FIG. 7 is a schematic plan view of the jam handling structure 8. FIG. 8 is a schematic plan view of the jam handling structure 8 in a state where the fixing device 7 is disposed at the jam handling position P21. FIG. 9 is a schematic side view of the fixing device 7 (in a pressurized state). FIG. 10 is a schematic side view of the fixing device 7 (in a reduced-pressure state).

As shown in FIG. 2 and FIG. 4, the jam handling structure 8 includes a cover 40 and a fixing jam handling portion 50. The cover 40 is provided in the rear surface of the apparatus main body 2 in such a way as to be opened and closed. The fixing jam handling portion 50 is provided in the fixing device 7. It is noted that the fixing jam handling portion 50 is also a component of the fixing device 7.

As shown in FIG. 2, the cover 40 includes an exterior plate 41 and a conveyance unit 42. The exterior plate 41 forms the rear surface of the apparatus main body 2 (see also FIG. 1). The conveyance unit 42 is provided on an inner side of the exterior plate 41.

As shown in FIG. 2, FIG. 6 and FIG. 7, the exterior plate 41 is, for example, formed in the shape of a rectangular plate from a synthetic resin material. The exterior plate 41 is attached to the apparatus main body 2 via a pair of hinges 43 provided in alignment in the up-down direction at a left end portion of the cover 40. That is, the cover 40 is supported by the apparatus main body 2 so as to pivot around a shaft that extends in the up-down direction at the left end portion (around a hinge pivot shaft 43A of each of the pair of hinges 43). Specifically, the cover 40 is configured to pivot between a closing position P10 and an opening position P11, wherein the cover 40 at the closing position P10 forms the rear surface of the apparatus main body 2 (see FIG. 1 and FIG. 2), and the cover 40 at the opening position P11 opens the rear surface of the apparatus main body 2 (see FIG. 6 and FIG. 7). The cover 40 is disposed at the closing position P10 when a normal image formation operation is performed, and is disposed at the intermediate transfer belt 11 when the jam handling process is performed. It is noted that, in a plan view, the cover 40 at the opening position P11 extends on the extension of the left side surface of the apparatus main body 2 (see FIG. 7). That is, the cover 40 is configured to pivot approximately 90 degrees.

As shown in FIG. 2, some of the plurality of pairs of conveyance rollers 23 that are positioned on the rear side are rotatably supported by an inner surface (a front surface) of the exterior plate 41. An outer surface (a rear surface) of the exterior plate 41 is provided with a release lever 44 for releasing an engagement (a lock) with the apparatus main body 2. When the user pulls the release lever 44, the exterior plate 41 (cover 40) is opened.

As shown in FIG. 2 and FIG. 6, the conveyance unit 42 is, for example, formed in the shape of a rectangular parallelepiped mainly from a synthetic resin material. Some of the plurality of pairs of conveyance rollers 23 that are positioned on the front side are rotatably supported by an outer surface (a rear surface) of the conveyance unit 42. One of the pair of registration rollers 22 and the secondary transfer roller 19 are rotatably supported by an inner surface (a front surface) of the conveyance unit 42. It is noted that the other of the pair of registration rollers 22 is rotatably supported by the apparatus main body 2. In addition, although not shown, the conveyance unit 42 is supported by the exterior plate 41 so as to pivot by using the left end portion as a fulcrum.

As shown in FIG. 2, in a state where the conveyance unit 42 is closed, the outer surface (rear surface) of the conveyance unit 42 faces the inner surface (front surface) of the exterior plate 41. That is, in a state where the rear surface of the apparatus main body 2 is closed (in a state where the cover 40 has been pivoted to the closing position P10), the inner surface of the exterior plate 41 and the outer surface of the conveyance unit 42 form the reverse conveyance path 21. In addition, in this state, the inner surface of the conveyance unit 42 forms a part of the conveyance path 20.

As shown in FIG. 4 and FIG. 5, the fixing jam handling portion 50 includes a fixing support shaft 51 and a pressure changing portion 52. The fixing support shaft 51 pivotably supports the fixing case 30. The pressure changing portion 52 changes a pressure (nip pressure) that acts on a contact surface (the fixing nip N2) between the fixing roller 31 and the pressure roller 32.

The fixing support shaft 51 is, for example, formed from a metal material in an approximate shape of a cylinder that is elongated in the up-down direction. A first gear G1 is fixed to an intermediate portion of the fixing support shaft 51 in the up-down direction, on the same axial center as the fixing support shaft 51. The first gear G1 is a so-called bevel gear.

The fixing support shaft 51 pierces through the fixing case 30 in the up-down direction, and pivotably supports the fixing case 30. In a plan view, the fixing support shaft 51 is disposed on the front side of the fixing case 30 at the left end portion (see FIG. 4). Opposite ends of the fixing support shaft 51 in the up-down direction are fixed to the left end portion of the apparatus main body 2 (see FIG. 5). Accordingly, the fixing device 7 is pivotably supported by the apparatus main body 2 so as to be disposed at the outside of the apparatus main body 2 in a state where the apparatus main body 2 is opened (in a state where the cover 40 has been pivoted to the opening position P11). Specifically, the fixing device 7 is provided so as to pivot around a shaft that extends in the up-down direction at the left end portion. More specifically, the fixing device 7 is configured to pivot between a fixing processing position P20 (see FIG. 7) and a jam handling position P21 (see FIG. 8), wherein the fixing processing position P2 is set in the interior of the apparatus main body 2, and the jam handling position P21 is set on the outside of the apparatus main body 2. The fixing device 7 is disposed at the fixing processing position P20 when a normal image formation operation is performed, and is disposed at the jam handling position P21 when the jam handling process is performed.

It is noted that the apparatus main body 2 and the fixing case 30 are each provided with a lock mechanism (not shown) that holds the fixing device 7 at the fixing processing position P20. Upon release from a lock by the lock mechanism, the fixing device 7 can be pivoted from the fixing processing position P20 to the jam handling position P21. In addition, as shown in FIG. 8, in a plan view, the fixing device 7 at the jam handling position P21 extends along the inner surface of the cover 40 that is at the opening position P11. That is, the fixing device 7 is configured to pivot approximately 90 degrees.

As shown in FIG. 4, FIG. 5 and FIG. 9, the pressure changing portion 52 includes the pair of movable sheet metals 53 and a cam mechanism 54. As described above, the pair of movable sheet metals 53 rotatably support the pressure roller 32 (the pressure metal core 32A). The cam mechanism 54 is configured to press the pressure roller 32 against the fixing roller 31.

Each of the pair of movable sheet metals 53 includes a holding arm 60, a pressing arm 61, and a pressing spring 62. The pair of movable sheet metals 53 have the same shape. Accordingly, in the following description, only one of the pair of movable sheet metals 53 is explained.

Each of the pair of holding arms 60 is fitted to an end portion of the pressure metal core 32A from the rear side (an opposite side to the fixing nip N2), and rotatably supports the pressure roller 32. An arm pivot shaft 60A is provided below the holding arm 60 (see FIG. 9). The holding arm 60 is configured to pivot around the arm pivot shaft 60A. The pressing arm 61 is disposed in rear of the holding arm 60. The pressing arm 61 is pivotably supported by the arm pivot shaft 60A of the holding arm 60. The pressing spring 62 is a so-called coil spring, and is stretched between the holding arm 60 and the pressing arm 61 (see FIG. 9). The pressing spring 62 is disposed at upper parts of the holding arm 60 and the pressing arm 61. The pressing spring 62 biases the holding arm 60 in a direction of separating from the pressing arm 61 (see the arrow of a two-dot chain line in FIG. 9).

The cam mechanism 54 includes a cam pivot shaft 63, a pair of eccentric cams 64, and a pair of cam follower portions 65.

The cam pivot shaft 63 is, for example, formed from a metal material in the approximate shape of a cylinder that is elongated in the left-right direction. The cam pivot shaft 63 is disposed in rear of the pressure roller 32 approximately in parallel to the pressure roller 32. The cam pivot shaft 63 is rotatably supported by the fixing case 30. A second gear G2 is fixed to the left end portion of the cam pivot shaft 63 so as to mesh with the first gear G1 of the fixing support shaft 51. The second gear G2 is a so-called bevel gear, and coaxially rotates with the cam pivot shaft 63.

The pair of eccentric cams 64 are fixed to the cam pivot shaft 63 so as to respectively correspond to the pair of movable sheet metals 53 (the pressing arms 61). Each of the pair of eccentric cams 64 is, for example, formed from a metal in the approximate shape of a disk. Each of the pair of eccentric cams 64 is a so-called disk cam which is formed such that a distance (eccentric radius) from the rotation center (the cam pivot shaft 63) to the circumferential surface is undefined. Each of the pair of cam follower portions 65 is formed from a metal in the approximate shape of a disk (see FIG. 9). The pair of cam follower portions 65 are respectively formed on the pair of pressing arms 61. Each of the pair of cam follower portions 65 receives a biasing force from the pressing spring 62 via the pressing arm 61, and is pressed against the circumferential surface (cam surface) of the eccentric cam 64. Each of the pair of eccentric cams 64 is configured to change the nip pressure by rotating in a state where its cam surface is in contact with the cam follower portion 65. It is noted that since the pair of eccentric cams 64 have the same shape, in the following description, only one of the pair of eccentric cams 64 is explained.

As shown in FIG. 9 and FIG. 10, the circumferential surface of the eccentric cam 64 is formed such that a pressurized cam surface F1 and a pressure-reduced cam surface F2 continue to each other. The pressurized cam surface F1 is formed on an opposite side to the pressure-reduced cam surface F2 across the rotation center. The pressurized cam surface F1 is larger in eccentric radius than the pressure-reduced cam surface F2.

As shown in FIG. 9, in the state where the pressurized cam surface F1 is in contact with the cam follower portion 65, the pressure roller 32 is pressed with such a strength that it sinks into the fixing roller 31 via the movable sheet metal 53. The nip pressure in this state is referred to as a first pressure that allows a normal image formation operation (fixing process) to be performed.

On the other hand, as shown in FIG. 10, in the state where the pressure-reduced cam surface F2 is in contact with the cam follower portion 65, the pressure roller 32 is approximately released from being pressed against the fixing roller 31, and is in light contact with the fixing roller 31 (or separated from the fixing roller 31). The nip pressure in this state is referred to as a second pressure that is lower than the first pressure. In the state where the nip pressure has been controlled to the second pressure, the jam handling process is performed.

As described above, the pressure changing portion 52 is configured to change the nip pressure between the first pressure and the second pressure by rotating the pair of eccentric cams 64. That is, it is possible to change the nip pressure by controlling the rotation angle of the pair of eccentric cams 64.

Next, the jam handling process (an action of the jam handling structure 8) is described. It is supposed here that the jam handling process is started in a state where the cover 40 is disposed at the closing position P10, and the fixing device 7 is disposed at the fixing processing position P20 (see FIG. 2). In addition, in the state where the fixing device 7 is disposed at the fixing processing position P20, the pressurized cam surfaces F1 of the pair of eccentric cams 64 are in contact with the pair of cam follower portions 65, and the nip pressure is set to the first pressure (see FIG. 9).

As described above, when a conveyance failure (a jam) of the sheet S occurs in the conveyance path 20 or the reverse conveyance path 21, the control device displays a message on a liquid crystal display or the like. The user performs the jam handling process in accordance with the message displayed on the liquid crystal display or the like.

First, the user releases the lock by pulling the release lever 44 of the exterior plate 41 (see FIG. 1), and pivots the cover 40 from the closing position P10 to the opening position P11 (see FIG. 6 and FIG. 7). This allows the conveyance path 20 to be exposed to outside, enabling the user to remove the sheet S jammed in the conveyance path 20 (at the pair of registration rollers 22, at the transfer nip N1 or the like).

In addition, when the user pivots the cover 40 to the opening position P11 and opens the conveyance unit 42 (pivots the conveyance unit 42 in a direction to move away from the exterior plate 41), the reverse conveyance path 21 is exposed to outside. This makes it possible to remove the sheet S jammed in the reverse conveyance path 21 (at the plurality of pairs of conveyance rollers 23 or the like).

In the following, a description is given of a case where the sheet S is jammed at the fixing nip N2 of the fixing device 7. First, the user releases the lock of the lock mechanism, and pivots the fixing device 7 from the fixing processing position P20 to the jam handling position P21 (see FIG. 8). This causes the second gear G2 to, while meshing with the first gear G1, pivot around the fixing support shaft 51 (see FIG. 4 and FIG. 5).

When the fixing device 7 rotates from the fixing processing position P20 to the jam handling position P21 (approximately 90 degrees), the second gear G2 (the cam pivot shaft 63) rotates approximately 180 degrees. Accordingly, since the pair of eccentric cams 64 also rotates approximately 180 degrees, the pair of cam follower portions 65 relatively move from the pressurized cam surfaces F1 to the pressure-reduced cam surfaces F2 (see FIG. 10). That is, the pressure-reduced cam surfaces F2 of the pair of eccentric cams 64 come into contact with the pair of cam follower portions 65, and the nip pressure is set to the second pressure (see FIG. 10). This makes it possible for the user to remove (pull out) the sheet S jammed at the fixing nip N2.

It is noted that after the removal of the sheet S (the jam handling process) is completed, the fixing device 7 is returned to the fixing processing position P20 and the cover 40 is returned to the closing position P10, by a procedure reverse to the above-described procedure.

Meanwhile, a conventional fixing device is stored in the apparatus main body. As a result, the worker had to perform the jam handling process in the narrow space of the apparatus main body. It is not easy for the worker to pull out a paper sheet so as not to break the paper sheet in the narrow space of the apparatus main body.

On the other hand, in the color printer 1 according to the present embodiment, the fixing device 7 is configured to pivot around an end portion (the left end portion) of the apparatus main body 2 in the horizontal direction so as to be exposed to the outside of the apparatus main body 2. With this configuration, it is possible to remove the sheet S jammed at the fixing nip N2 in a state where a most part of the fixing device 7 is disposed on the outside of the apparatus main body 2. This allows the jam handling process to be performed effectively on the outside of the apparatus main body 2.

In addition, in the color printer 1 according to the present embodiment, the pressure changing portion 52 sets the pressure at the fixing nip N2 to the first pressure in the state where the fixing device 7 is disposed at the fixing processing position P20, and sets the pressure at the fixing nip N2 to the second pressure in the state where the fixing device 7 is disposed at the jam handling position P21. That is, the pressure changing portion 52 is configured to reduce the pressure applied to the fixing nip N2 in conjunction with the opening of the fixing device 7. With this configuration, it is possible to pull out the sheet S jammed at the fixing nip N2 by a small force without breaking the sheet S. This allows the jam handling process to be performed more easily.

Furthermore, in the color printer 1 according to the present embodiment, in a state where the rear surface of the apparatus main body 2 is closed, the cover 40 forms a part of the conveyance path 20 (the reverse conveyance path 21) through which the sheet S passes. That is, the cover 40 serves both as the exterior of the apparatus main body 2 and the conveyance path 20 and the like. This makes it possible to omit dedicated parts from the conveyance path 20 and the like, and reduce the manufacturing cost of the color printer 1.

In addition, in the color printer 1 according to the present embodiment, the cover 40 is configured to pivot around an end portion (the left end portion) in the horizontal direction. With this configuration, it is possible to secure large spaces above and below the fixing device 7 pivoted to the jam handling position P21, which allows the user to check (view) the upstream side and the downstream side of the fixing nip N2 easily. This makes it possible to perform the jam handling process smoothly.

It is noted that in the color printer 1 according to the present embodiment, the cover 40 and the fixing device 7 pivot around the left end portion. However, the present disclosure is not limited to the configuration. For example, the cover 40 and the fixing device 7 may be configured to pivot around the right end portion. As another example, the cover 40 may be supported by the apparatus main body 2 so as to be able to pivot by using the lower end portion as a fulcrum. In addition, in the above-described embodiment, the rotation angle of the cover 40 and the fixing device 7 is set to approximately 90 degrees. However, not limited to this, the rotation angle may be set to approximately equal to or larger than 90 degrees (alternatively, to approximately equal to or smaller than 90 degrees).

In addition, in the color printer 1 according to the present embodiment, since the conveyance path 20 and the fixing device 7 are provided in a rear part of the apparatus main body 2, the cover 40 is configured to form the rear surface of the apparatus main body 2. However, the present disclosure is not limited to this configuration. For example, in the case where the conveyance path 20 and the fixing device 7 are provided at a side of the apparatus main body 2, the cover 40 may form the side (or a part of the side) of the apparatus main body 2, and the cover 40 and the fixing device 7 may be configured to pivot sideways.

Figure 11:
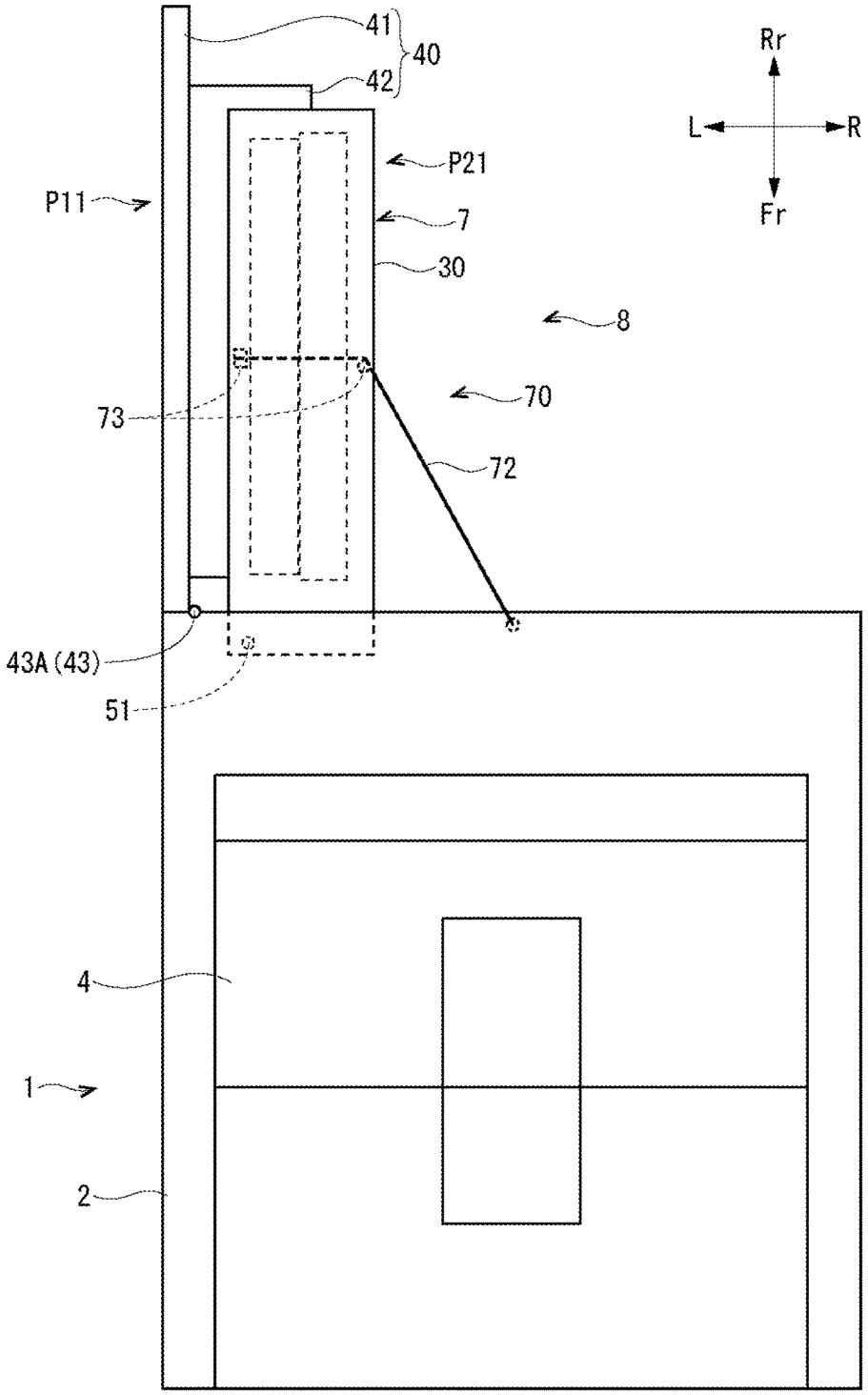
FIG. 11 is a schematic plan view of a jam handling structure of a color printer according to a modification of the embodiment of the present disclosure.
Figure 12:
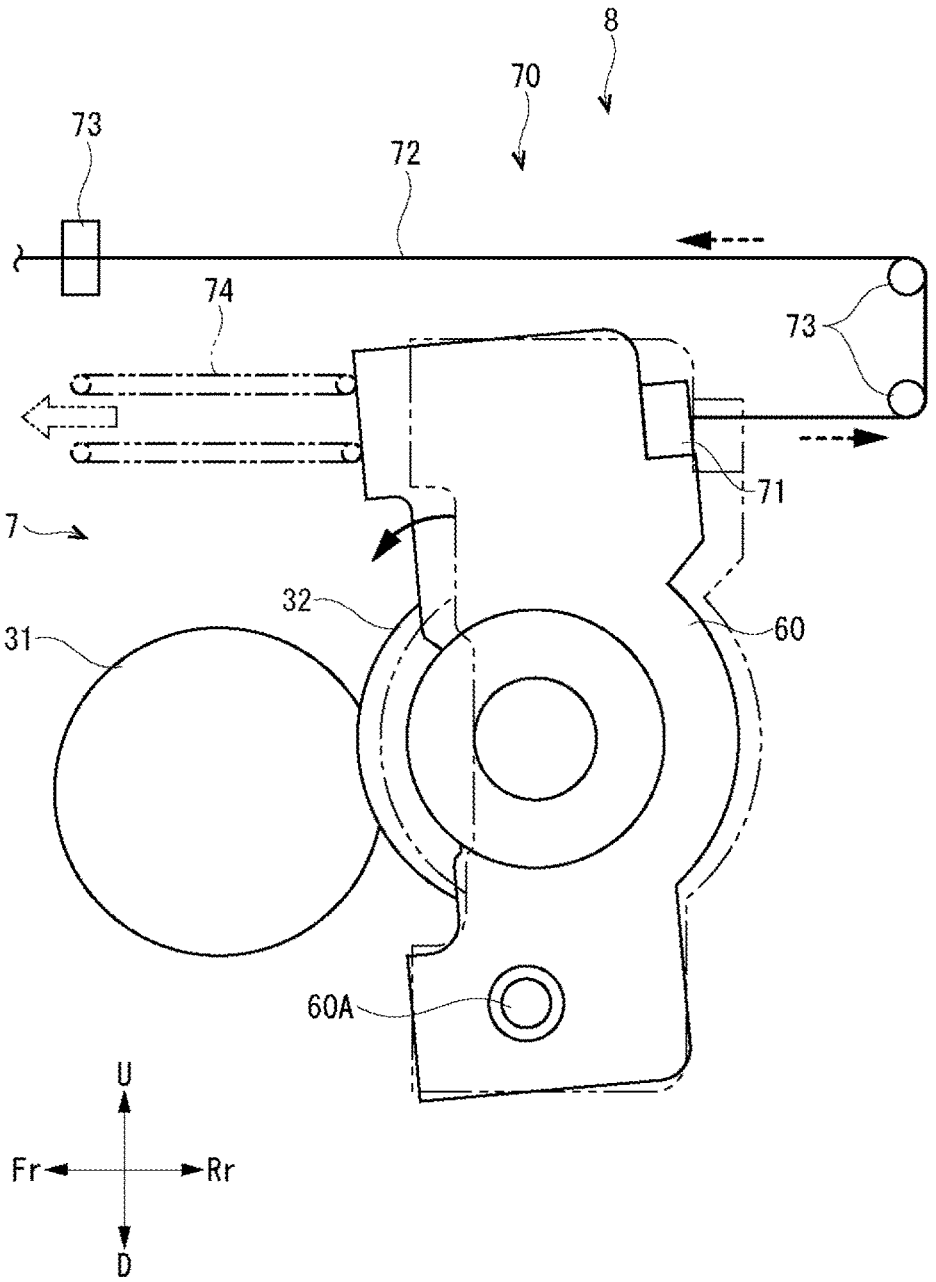
FIG. 12 is a schematic side view of a fixing device of the color printer according to the modification of the embodiment of the present disclosure.

Furthermore, in the color printer 1 according to the present embodiment, the pressure changing portion 52 of the fixing device 7 changes the nip pressure by using the gears G1 and G2 and the pair of eccentric cams 64. However, the present disclosure is not limited to this configuration. For example, as shown in FIG. 11 and FIG. 12, a pressure changing portion 70 includes a wire 72 connected to the apparatus main body 2 and an installation member 71 that is stretched between the pair of holding arms 60. The orientation of the wire 72 is changed by a plurality of pins 73 before it is connected to the installation member 71. In this case, the pressing arms 61 are omitted. Biased by a tension spring 74 provided in place of the pressing spring 62, the pair of holding arms 60 press the pressure roller 32 against the fixing roller 31. In the pressure changing portion 70, the wire 72 is pulled during a process in which the fixing device 7 pivots from the fixing processing position P20 to the jam handling position P21. Following this, the pair of holding arms 60 are pulled rearward via the wire 72, and the pressure roller 32 is approximately released from being pressed against the fixing roller 31 (see the two-dot chain line in FIG. 12). This makes it possible to change the nip pressure from the first pressure to the second pressure. It is noted that the number of pins 73 is arbitrary as far as one or more pins 73 are provided.

It is noted that in the color printer 1 according to the present embodiment (including the modifications: the same applies to the following description), the pressure changing portion 52 and 70 change the nip pressure by moving the pressure roller 32. However, the present disclosure is not limited to this configuration. For example, the pressure changing portion 52 and 70 may change the nip pressure by moving the fixing roller 31.

In addition, the pressure changing portion 52 and 70 may be omitted from the jam handling structure 8 of the color printer 1 according to the present embodiment. Even with this configuration, the fixing device 7 can be disposed at the jam handling position P21 so that the user can firmly grasp and pull out (remove) the sheet S jammed at the fixing nip N2. This makes it possible to secure facilitating the jam handling process.

In addition, in the fixing device 7 of the color printer 1 according to the present embodiment, the fixing roller 31 is provided as an example of the fixing member. However, not limited to this, a belt stretched between a plurality of rollers may be provided as the fixing member. Furthermore, similarly, a belt stretched between a plurality of rollers may be provided as the pressure member, in place of the pressure roller 32.

In addition, in the present embodiment, a case where the present disclosure is applied to the color printer 1 is described. However, not limited to this, for example, the present disclosure may be applied to a monochrome printer, a copier, a facsimile, a multifunction peripheral or the like.

It is noted that the above-described embodiment describes an aspect of the image forming apparatus according to the present disclosure, and the technical scope of the present disclosure is not limited to the above-described embodiment.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an apparatus main body formed such that an interior thereof can be opened; and a fixing device provided in the interior of the apparatus main body and configured to fix a toner image on a medium to the medium by heating and pressing the toner image, wherein the fixing device is supported by the apparatus main body in such a way as to pivot so as to be disposed on an outside of the apparatus main body in a state where the interior of the apparatus main body is opened, and the fixing device is supported by the apparatus main body in such a way as to pivot around a shaft that extends in a vertical direction at an end portion of the apparatus main body in a horizontal direction.

2. An image forming apparatus comprising:

an apparatus main body formed such that an interior thereof can be opened; and a fixing device provided in the interior of the apparatus main body and configured to fix a toner image on a medium to the medium by heating and pressing the toner image, wherein the fixing device includes:

a fixing member configured to, while rotating, heat the toner image on the medium;

a pressure member configured to, while rotating and being in contact with the fixing member, form a nip and press the medium while the medium is passing through the nip; and a pressure changing portion configured to change a pressure applied to the nip, the fixing device is supported by the apparatus main body in such a way as to pivot so as to be disposed on an outside of the apparatus main body in a state where the interior of the apparatus main body is opened, the fixing device is configured to pivot between a fixing processing position set in the interior of the apparatus main body, and a jam handling position set on an outside of the apparatus main body, and the pressure changing portion sets the pressure applied to the nip to a first pressure in a state where the fixing device is disposed at the fixing processing position, and sets the pressure applied to the nip to a second pressure in a state where the fixing device is disposed at the jam handling position, the second pressure being lower than the first pressure.

3. An image forming apparatus comprising:

an apparatus main body formed such that an interior thereof can be opened;

a fixing device provided in the interior of the apparatus main body and configured to fix a toner image on a medium to the medium by heating and pressing the toner image; and a cover configured to open and close a part of a side surface of the apparatus main body, wherein the fixing device is supported by the apparatus main body in such a way as to pivot so as to be disposed on an outside of the apparatus main body in a state where the interior of the apparatus main body is opened, in a state where the cover closes the part of the side surface of the apparatus main body, the cover forms a part of a conveyance path through which the medium passes, the conveyance path is formed to extend along a vertical direction, and the cover is supported by the apparatus main body in such a way as to pivot around a shaft that extends in the vertical direction at an end portion of the apparatus main body in a horizontal direction.

* * * * *